US011568700B2

(12) United States Patent
Sakamoto

(10) Patent No.: US 11,568,700 B2
(45) Date of Patent: Jan. 31, 2023

(54) SHEET PROCESSING APPARATUS

(71) Applicant: GLORY LTD., Himeji (JP)

(72) Inventor: Masao Sakamoto, Himeji (JP)

(73) Assignee: GLORY LTD., Himeji (JP)

( * ) Notice: Subject to any disclaimer, the term of this patent is extended or adjusted under 35 U.S.C. 154(b) by 278 days.

(21) Appl. No.: 16/820,956

(22) Filed: Mar. 17, 2020

(65) Prior Publication Data

US 2020/0302726 A1 Sep. 24, 2020

(30) Foreign Application Priority Data

Mar. 19, 2019 (JP) ..... JP2019-051440

(51) Int. Cl.
*G07D 11/125* (2019.01)
*G07D 11/13* (2019.01)
(Continued)

(52) U.S. Cl.
CPC ..... *G07D 11/28* (2019.01); *G07D 7/181* (2017.05); *G07D 11/125* (2019.01); *G07D 11/13* (2019.01);
(Continued)

(58) Field of Classification Search
CPC ..... G07F 19/202; G07F 19/20; G07F 19/209; G07D 11/13; G07D 11/25; G07D 11/28;
(Continued)

(56) References Cited

U.S. PATENT DOCUMENTS 6,929,109 B1 * 8/2005 Klein ..... G07D 11/40 194/207
8,538,123 B1 * 9/2013 Csulits ..... G06V 10/987 235/379
(Continued)

FOREIGN PATENT DOCUMENTS

EP 3220364 A1 9/2017
JP S63045693 A 2/1988
(Continued)

OTHER PUBLICATIONS

The Extended European Search Report for European Application No. 20163915.0-1009 dated Aug. 10, 2020.

*Primary Examiner* — Daniel I Walsh
(74) *Attorney, Agent, or Firm* — Renner, Kenner, Greive, Bobak, Taylor & Weber

(57) ABSTRACT

A sheet processing apparatus in the present invention operates in a self-service mode, in which a user does not receive operation support provided by an operation assistant, and a non-self-service mode, in which the user receives the operation support. The sheet processing apparatus includes an inlet that takes in sheets in a deposit process, a transport section that transports the sheets taken in from the inlet, storage sections that store the sheets transported by the transport section, and a control section that causes the transport section in such a way as to transport the sheets to the storage sections on a basis of storage conditions for storing the sheets in the storage sections. The control section changes the storage conditions for at least one of the storage
(Continued)

sections between the self-service mode and the non-self-service mode.

16 Claims, 2 Drawing Sheets

(51) Int. Cl.
*G07D 11/28* (2019.01)
*G07D 7/181* (2016.01)
*G07D 11/14* (2019.01)
*G07F 19/00* (2006.01)

(52) U.S. Cl.
CPC ..... *G07D 11/14* (2019.01); *G07F 19/202* (2013.01); *G07D 2207/00* (2013.01); *G07D 2211/00* (2013.01)

(58) Field of Classification Search
CPC ..... G07D 11/125; G07D 11/50; G07D 11/12; G07D 11/009
See application file for complete search history.

(56) References Cited

U.S. PATENT DOCUMENTS 8,600,842 B1 * 12/2013 Sanders ..... G07F 19/209 705/16
10,657,751 B2 * 5/2020 Nguyen ..... G06Q 40/02
11,134,798 B1 * 10/2021 Yang ..... G06Q 20/18
11,263,857 B1 * 3/2022 Miller ..... G07D 11/34
2003/0015395 A1 * 1/2003 Hallowell ..... B65H 33/08 194/206
2004/0205025 A1 * 10/2004 Takeuchi ..... G06Q 20/40 705/64
2007/0045397 A1 * 3/2007 Ireland ..... G07F 19/205 235/379
2007/0145115 A1 * 6/2007 Savage ..... G06Q 40/00 235/379
2008/0093441 A1 * 4/2008 Taylor ..... G07F 19/211 235/379
2008/0289929 A1 * 11/2008 Wilfer ..... G07D 11/28 194/302
2010/0170911 A1 * 7/2010 Gunst ..... G07F 19/20 221/217
2011/0047074 A1 * 2/2011 Cai ..... G07F 7/0886 705/41
2011/0155026 A1 * 6/2011 Villiger ..... G07D 11/30 109/40
2012/0226590 A1 * 9/2012 Love ..... G06Q 40/12 705/30
2013/0043106 A1 * 2/2013 Iizuka ..... B65H 29/58 198/570
2013/0191230 A1 * 7/2013 Edwards ..... G07G 1/0009 705/16
2014/0149286 A1 * 5/2014 Forsyth ..... G07F 19/20 705/43
2015/0058215 A1 * 2/2015 Johnson ..... G06Q 20/1085 705/43
2015/0114794 A1 * 4/2015 Park ..... G07D 7/128 194/207
2015/0178692 A1 * 6/2015 Nishida ..... G07D 11/50 705/45
2015/0356526 A1 * 12/2015 Christmas ..... G07F 19/206 705/43
2016/0071371 A1 * 3/2016 Pececnik ..... G07F 17/3248 463/25
2016/0078528 A1 * 3/2016 Pradeep ..... G06Q 20/18 705/39
2016/0171461 A1 * 6/2016 Hoover ..... G07F 19/20 705/43
2016/0350995 A1 * 12/2016 Mizuno ..... G07D 7/003
2017/0003856 A1 * 1/2017 Mande ..... G06Q 10/20
2017/0304870 A1 * 10/2017 Takahama ..... B65B 27/08
2018/0350181 A1 * 12/2018 Li ..... G07D 11/175
2020/0065786 A1 * 2/2020 Swaine ..... G06Q 20/18
2020/0066079 A1 * 2/2020 Swaine ..... G07D 11/60
2020/0302726 A1 * 9/2020 Sakamoto ..... G07D 7/181
2020/0342428 A1 * 10/2020 Benkreira ..... G07D 11/30
2021/0097540 A1 * 4/2021 Sumpter ..... G06V 40/172
2022/0148390 A1 * 5/2022 Lopez ..... G07F 19/205

FOREIGN PATENT DOCUMENTS

JP H05996479 A 1/1993
JP H09147182 A 6/1997
JP H1031778 A 2/1998
JP 2013127738 A 6/2013
JP 2013205909 A 10/2013
JP 2014-109963 6/2014

* cited by examiner

SHEET PROCESSING APPARATUS

CROSS REFERENCE TO RELATED APPLICATIONS

This application is entitled to (or claims) the benefit of Japanese Patent Application No. 2019-051440, filed on Mar. 19, 2019, the disclosure of which including the specification, drawings and abstract is incorporated herein by reference in its entirety.

TECHNICAL FIELD

The present invention relates to a sheet processing apparatus used to process sheets.

BACKGROUND ART

As sheet processing apparatuses used to process sheets, banknote processing apparatuses that perform processes for depositing and withdrawing banknotes, for example, have been conventionally used (see, for example, PTL 1).

CITATION LIST

Patent Literature

PTL 1
Japanese Patent Application Laid-Open No. 2014-109963

SUMMARY OF INVENTION

Technical Problem

With regard to sheet processing apparatuses, which are typified by such banknote processing apparatuses, it is desired to improve convenience by performing appropriate operations in accordance with various use conditions.

The present invention has been conceived to solve this problem and aims to improve convenience.

Solution to Problem

In order to solve the problems mentioned above, a sheet processing apparatus of the present invention is an apparatus that operates in a self-service mode in which a user does not receive operation support provided by an operation assistant, and a non-self-service mode in which the user receives the operation support, the sheet processing apparatus including: an inlet that takes in sheets in a deposit process; a transport section that transports the sheets taken in from the inlet; a plurality of storage sections that store the sheets transported by the transport section; and a control section that causes the transport section to transport the sheets to the plurality of storage sections, based on storage conditions for storing the sheets in the plurality of storage sections, in which the control section changes the storage conditions for at least one of the plurality of storage sections between when an operation mode is the self-service mode and when the operation mode is the non-self-service mode.

Advantageous Effects of Invention

According to the present invention, convenience can be improved.

DESCRIPTION OF EMBODIMENTS

Figure 1:
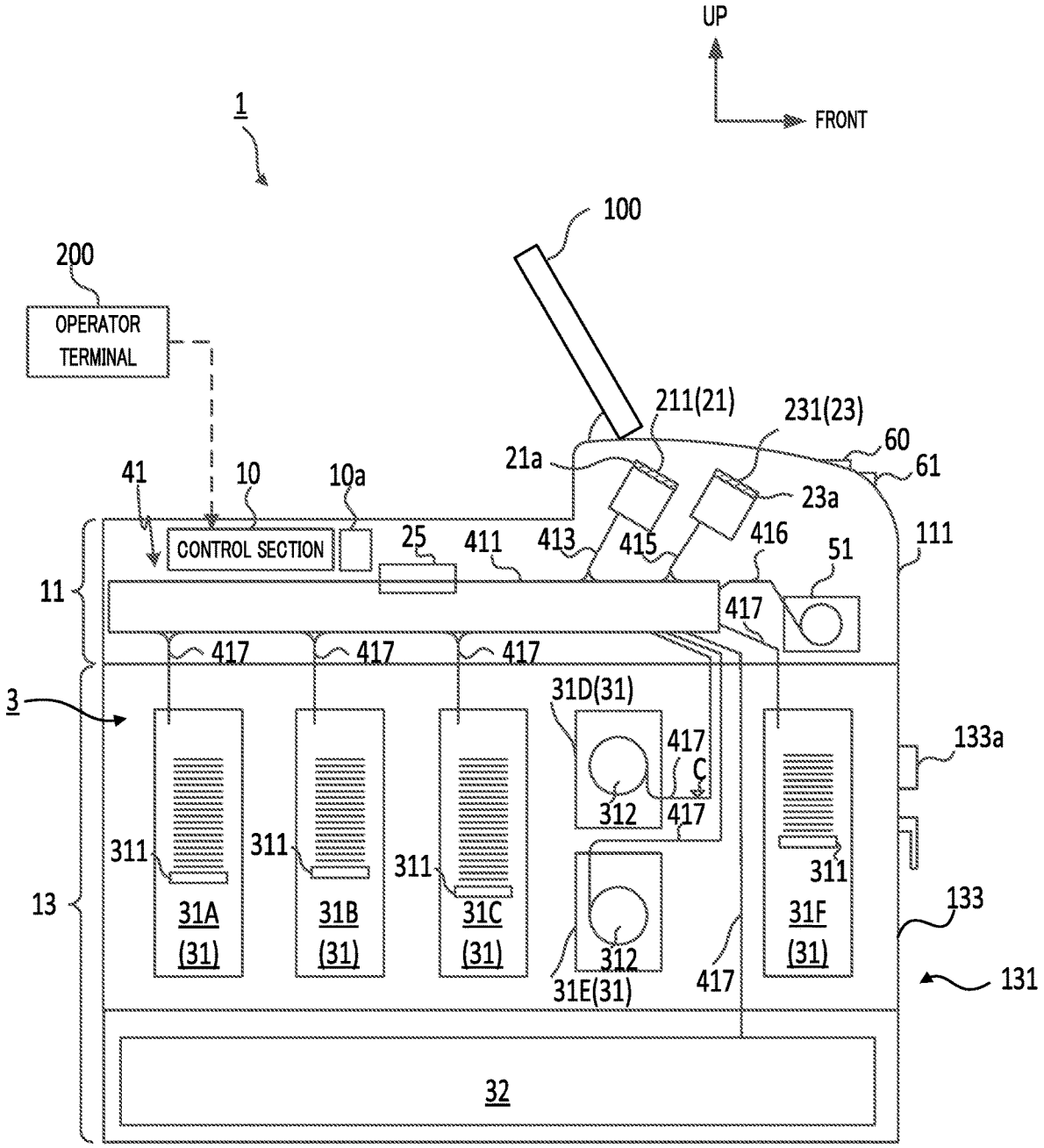
FIG. 1 is a schematic side view illustrating the configuration of a sheet processing apparatus.

A banknote processing apparatus as an embodiment of a sheet processing apparatus in the present invention will be described hereinafter with reference to the drawings. The following embodiment is just an illustration, and does not exclude various modifications and applications of techniques that are not specified in the following embodiment. Moreover, components according to the embodiment may be implemented while being variously modified without departing from the spirit and scope of the present invention. Furthermore, each of the components according to the embodiment may be selected or omitted as necessary or may be combined with another component as desired.

In all the drawings for illustrating the embodiment, the same elements are basically given the same reference numerals, and description thereof might be omitted.

1. Configuration

The configuration of the banknote processing apparatus according to the embodiment of the present invention will be described in detail hereinafter with reference to the drawings. FIG. 1 is a schematic side view illustrating the configuration of a banknote processing apparatus 1 according to the embodiment of the present invention.

In the following description, a side of the banknote processing apparatus 1 on which an operation display section 100 (first operation terminal) is provided will be regarded as a front side, and an opposite side will be regarded as a back side. In addition, a horizontal direction perpendicular to a fore-and-aft direction will be referred to as a "width direction".

The banknote processing apparatus 1 illustrated in FIG. 1 is an apparatus that is provided in a lobby of a bank and that enables a customer (user) of the bank to perform deposit and withdrawal processes and the like using the operation display section 100. That is, the customer of the bank inputs operation instructions to a control section 10 of the banknote processing apparatus 1 through the operation display section 100. In a certain period of time such as business hours of the bank, the banknote processing apparatus 1 is capable of communicating with an operator terminal 200 (second operation terminal) used by an operator (operation assistant) in the bank. If a problem or the like arises while the customer is using the banknote processing apparatus 1, the operator provides support (operation support) for addressing the problem through the operator terminal 200. For example, the operator can output an operation instruction to the control section 10 of the banknote processing apparatus 1 using the operator terminal 200 to display guidance for addressing the problem on the operation display section 100. Alternatively, in the certain period of time such as the business hours of the bank, the operator in the bank may provide support using the operation display section 100.

A self-service state and a non-self-service state of the banknote processing apparatus 1 will be described hereinafter. The self-service state refers to a state in which settings at a time when the customer of the bank independently operates the banknote processing apparatus 1 have been made. In other words, the self-service state is a state in which settings have been made for the banknote processing apparatus 1 for a period of time other than the business hours of the bank or any other organization in which the banknote processing apparatus 1 is installed. The non-self-service state refers to a state in which settings have been made such that the operation assistant in the bank can provide support for the customer of the bank if necessary when the customer operates the banknote processing apparatus 1. In other words, the non-self-service state is a state in which settings have been made for the banknote processing apparatus 1 for the business hours of the bank or any other organization in which the banknote processing apparatus 1 is installed.

An example of the settings for the self-service state is settings of the banknote processing apparatus 1 with which a shutter 23*a* of an outlet 231 operates in accordance with an operation state of the banknote processing apparatus 1. An example of the settings for the non-self-service state is settings of the banknote processing apparatus 1 with which the shutter 23*a* of the outlet 231 remains constantly removed (constantly open) regardless of the operation state of the banknote processing apparatus 1.

Another example of the settings for the self-service state is settings of the banknote processing apparatus 1 with which the control section 10 does not receive operation instructions from the operator terminal 200. Another example of the settings for the non-self-service state is settings of the banknote processing apparatus 1 with which the control section 10 can receive operation instructions from the operator terminal 200.

The banknote processing apparatus 1 processes banknotes while changing various settings and the like between an operation mode in the self-service state (hereinafter referred to as a "self-service mode") and an operation mode in the non-self-service state (hereinafter referred to as a "non-self-service mode"), details of which will be described later.

The banknote processing apparatus 1 is roughly divided into an upper processing section 11 and a lower safe section 13. In a case 111 that forms the processing section 11, an inlet section 21 comprising an inlet 211, an outlet section 23 comprising an outlet 231, a recognition section 25 that recognizes banknotes (sheets), a temporary storage section 51 that temporarily stores banknotes, and a transport section 41 comprising a transport path 411 that connects the inlet section 21, the outlet section 23, the recognition section 25, and the temporary storage section 51 to one another are provided. A case 131 provided under the case 111 that forms the processing section 11, on the other hand, forms the safe section 13 and is configured such that a storage section 3 stored therein is protected with a certain level of security or higher. The case 131 will also be referred to as a protection case 131 hereinafter. Although the transport path 411 is formed in a shape of a ring in FIG. 1, the shape of the transport path 411 is not limited to this. For example, the transport path 411 may be a transport path partly formed in the shape of a ring or a transport path that does not have a part formed in the shape of a ring, instead. When the transport path 411 has a ring-shaped part, banknotes can circulate through the ring-shaped part.

The above-described operation display section 100 is mounted on a forward part of an upper surface of the processing section 11. The operation display section 100 is, for example, a touch panel. The operation display section 100 displays a processing condition of a process for depositing banknotes or the like in the banknote processing apparatus 1, information regarding the inventory number of banknotes stored in storage cassettes 31A to 31F, and the like. As described above, the customer can give various instructions to the control section 10 using the operation display section 100.

The safe section 13 is provided with the storage section 3 comprising a plurality of (six in the example illustrated in FIG. 1) storage cassettes 31A to 31F and one collection cassette 32. In the following description, the storage cassettes 31A to 31F will be referred to as "storage cassettes 31" when generically referred to. The storage cassettes 31 and the collection cassette 32 will be described in detail later.

A door 133 is provided on a front surface of the protection case 131. By opening and closing the door 133, an open state and a closed state of the safe section 13 can be switched. An electronic lock 133*a* is provided in a front surface of the door 133 and can be unlocked, for example, by inputting a preset password. After the electronic lock 133*a* is unlocked, the door 133 can be opened and the storage section 3 can be accessed (contacted).

The inlet 211 is a port for putting in banknotes to be deposited in, for example, the deposit process. The inlet 211 opens upward in the upper surface of the processing section case 111 and is capable of receiving a plurality of banknotes at once. The inlet section 21 also comprises a feeding mechanism for feeding the plurality of banknotes put in the inlet 211 to the transport path 411 one by one. The inlet section 21 is also provided with a shutter 21*a* that opens and closes the inlet 211. FIG. 1 illustrates a state in which the shutter 21*a* has closed the inlet 211. Although an example in which the shutter 21*a* is provided for the inlet 211 is illustrated in FIG. 1, the shutter 21*a* need not be provided for the inlet 211, instead.

The outlet 231 is a port for feeding out banknotes in, for example, the withdrawal process. The outlet 231 opens upward in the upper surface of the processing section case 111 at a closer position than the inlet 211 in a depth direction. The outlet 231 comprises a lift (not illustrated) capable of stacking transported banknotes on one another and holding a plurality of banknotes at once. The outlet section 23 is also provided with the shutter 23*a* that opens and closes the outlet 231. FIG. 1 illustrates a state in which the shutter 23*a* has closed the outlet 231. Although an example in which the shutter 23*a* is provided for the outlet 231 is illustrated, the shutter 23*a* need not be provided for the outlet 231, instead.

The recognition section 25 is provided on the transport path 411 and configured to check the authenticity, denomination, and fitness of each of banknotes transported along the transport path 411.

The transport section 41 comprises the transport path 411 provided inside the processing section case 111. Banknotes are transported along the transport path 411 clockwise and counterclockwise in FIG. 1. Although not illustrated, the transport path 411 is achieved by a combination of a large number of rollers, a plurality of belts, motors that drive the rollers and the belts, sensors that detect transported banknotes, and a plurality of guides. The transport path 411 transports banknotes along the transport path 411 one by one with a certain gap provided between adjacent sheets. The transport path 411 and the inlet 211 are connected to each other by an input path 413, and banknotes put in the inlet 211 are transported to the transport path 411 along the input path 413.

Branch paths 417 connected to the storage cassettes 31A to 31F and the collection cassette 32, respectively, are connected to the transport path 411 through diverters, which are not illustrated. As a result of operation control performed by the diverters, banknotes that are being transported along the transport path 411 are selectively transported to and stored in any of the storage cassettes 31A to 31F and the collection cassette 32 along the corresponding branch path 417. The storage cassettes 31A to 31F each comprise a mechanism for feeding stored banknotes. The banknotes fed from any of the storage cassettes 31A to 31F are transported to the transport path 411 along the corresponding branch path 417. The collection cassette 32 does not comprise a mechanism for feeding stored banknotes. That is, the collection cassette 32 stores banknotes that are not to be withdrawn, namely, for example, largest-denomination notes, unfit notes, and counterfeit notes.

The branch paths 417 are each provided with optical sensors C for detecting skew angles of banknotes. FIG. 1 illustrates only the optical sensors C for the branch path 417 leading to the storage cassette 31D for the sake of convenience.

Output paths 415 are also connected to the transport path 411 through diverters (not illustrated) for switching transport directions of banknotes. Leading ends of the output paths 415 are connected to the outlet 231. Banknotes that are being transported along the transport path 411 are selectively transported to the outlet 231 through the output paths 415 as a result of operation control performed by the diverters.

A branch path 416 connected to the temporary storage section 51 is also connected to the transport path 411 through a diverter, which is not illustrated.

Banknotes that are being transported along the transport path 411 clockwise or counterclockwise are selectively transported to the temporary storage section 51 through the branch path 416 as a result of operation control performed by the diverter. Banknotes fed from the temporary storage section 51 and transported through the branch path 416 are transported along the transport path 411 clockwise or counterclockwise.

As described above, the storage section 3 comprises the six storage cassettes 31A to 31F. More specifically, the storage cassettes 31A, 31B, and 31C are arranged in this order from the back to the front of the apparatus (from the left to the right in FIG. 1). The storage cassettes 31D and 31E are vertically arranged in front of the storage cassette 31C, and the storage cassette 31F is arranged in front of the storage cassettes 31D and 31E. Among the storage cassettes 31A to 31F, the storage cassettes 31A to 31C and 31F are of a stacking type, and the storage cassettes 31D and 31E are of a winding type. The storage cassettes 31A, 31B, and 31C constitute a first storage section in the present invention, the storage cassettes 31D and 31E constitute a second storage section in the present invention, and the storage cassette 31F constitutes a third storage section.

As illustrated in FIG. 1, inside each of the storage cassettes 31A to 31C and 31F of the stacking type, a stacking board 311 that moves up and down in accordance with the number of banknotes stacked thereon is provided. The storage cassettes 31A to 31C and 31F are configured to stack banknotes on one another transported thereinto from the transport path 411 through respective slots thereof on the stacking boards 311 from bottom to top and feed the banknotes stacked on the stacking boards 311 on one another to the transport path 411 through the respective slots thereof one by one from top to bottom. A storage cassette of the stacking type refers to a cassette in which banknotes are stacked on one another with surfaces of the banknotes substantially parallel to an inner bottom surface of the cassette.

The storage cassettes 31D and 31E of the winding type are each configured to comprise a strip of tape for guiding banknotes, a guide member, and a reel 312 that winds up the strip of tape along with banknotes inside a case having a shape of a substantially rectangular box or comprise two strips of tape for pinching banknotes and a reel 312 that winds up the two strips of tape pinching banknotes inside a case. With either configuration, the storage cassettes 31D and 31E of the winding type wind up and store banknotes one by one and feed the banknotes one by one in reverse order to order of storage, that is, the storage cassettes 31D and 31E of the winding type store banknotes using a first-in, last-out method.

Although not illustrated, the storage section 3 can be drawn out with the door 133 of the safe section 13 open. The operator can individually open the storage cassettes 31A to 31F of the drawn out storage section 3 and take out stored banknotes. In addition, the storage section 3 is configured such that the collection cassette 32 can be taken out of the safe section 13 with the door 133 open.

Furthermore, as described later, the storage cassettes 31D, 31E, and 31F can also be used as collection cassettes and removably attached to the safe section 13. As with the collection cassette 32, therefore, the storage cassettes 31D, 31E, and 31F can be taken out of the safe section 13 with the door 133 open.

As described above, the temporary storage section 51 is connected to the branch path 416. The temporary storage section 51 temporarily stores banknotes rejected during, for example, the withdrawal process. The temporary storage section 51 is, as with the storage cassettes 31D and 31E, of the winding type.

The banknote processing apparatus 1 also comprises a card reader 60 and a biometric authentication apparatus 61 in a front part thereof. The card reader 60 reads account information recorded in a cash card or the like carried by the customer. The biometric authentication apparatus 61 is used to identify recognition information regarding the customer, who is a user of the banknote processing apparatus 1, through biometric authentication and obtains information regarding a fingerprint or a retina of the customer.

The banknote processing apparatus 1 also comprises a memory section 10*a* that stores various pieces of information.

2. Non-Self-Service Mode and Self-Service Mode

As described above, the banknote processing apparatus 1 operates in the self-service mode or the non-self-service mode as the operation mode.

The control section 10 switches between the non-self-service mode and the self-service mode in accordance with a period of time. For example, the control section 10 determines the period of time on the basis of time information obtained from the outside or time information obtained using a timer function of the control section 10. The control section 10 then sets the operation mode of the banknote processing apparatus 1 to the non-self-service mode in working hours (e.g., 9 a.m. to 6 p.m.) of the operator and the self-service mode in non-working hours (e.g., 6 p.m. to 9 a.m.) of the operator.

Alternatively, the operator may switch between the non-self-service mode and the self-service mode using the operator terminal 200 or the operation display section 100, instead of, or in addition to, the switching performed by the control section 10 in accordance with the period of time. In this case, the operator terminal 200 or the operation display section 100 corresponds to a "mode selection section that receives an operation for selecting the operation mode" in the present invention.

Since the customer cannot receive support from the operator in the self-service mode, the operation of the banknote processing apparatus 1 is restricted so that a process for collecting banknotes and a process for addressing a problem become unnecessary. More specifically, the banknote processing apparatus 1 changes modes for items (1) to (15) on Table 1 below between the non-self-service mode and the self-service mode. Items (1) to (6) relate to changes in various settings of the banknote processing apparatus 1, items (7) to (12) relate to changes in various operations of the banknote processing apparatus 1, and items (13) to (15) relate to changes in security of the banknote processing apparatus 1. The items will be described hereinafter.

TABLE 1

| | Item | Non-self-service mode | Self-service mode |
|---|---|---|---|
| Settings | (1) Restriction on denominations | Set large-denomination notes and small-denomination notes | Set only large-denomination notes (avoidance of full state due to small-denomination notes) |
| | (2) Adjustment of capacity | Set large-denomination notes and small-denomination notes evenly | Set more large-denomination notes |
| | (3) Restriction on reception | No restriction on denominations to be received | Receive only large-denomination notes (avoidance of full state due to small-denomination notes) |
| | (4) Adjustment of fitness threshold | Make fitness threshold determination generous | Make fitness threshold determination strict |
| | (5) Restriction on reception of unfit notes | Receive unfit notes (soiled, thickened, mutilated) | Do not receive unfit notes (thickened, mutilated) |
| | (6) Adjustment of jams | Make jam monitoring timer strict | Make jam monitoring timer generous |
| Operations | (7) Shutter operation | Operate with shutter open | Open only during setting and takeout of banknotes |
| | (8) Destination of reset notes | Outlet | Collection box |
| | (9) Deposit process | Direct deposit (difficult to fix errors) | Indirect deposit (easy to fix errors) |
| | (10) Restriction on processes | No restriction | Only deposit |
| | (11) Restriction on number of transactions | No restriction on number of transactions | Restrict number of transactions |
| | (12) Collection of counterfeit notes | Collect only counterfeit notes | Collect counterfeit notes and suspect notes |
| Security | (13) Login | Card alone | Card and biometric authentication |
| | (14) Unlocking condition of safe door | Password for electronic key alone | Password for electronic lock and server authentication |
| | (15) Maintenance worker mode | Maintenance worker mode possible | Maintenance worker mode impossible |

(1) Restriction on Denominations (1-1) In the non-self-service mode, the control section 10 sets, for the storage cassettes 31A to 31C, a condition (hereinafter referred to as a "storage condition") that only large-denomination notes be stored and, for the storage cassettes 31D to 31F, a storage condition that only small-denomination notes be stored.

In the self-service mode, on the other hand, the control section 10 sets, for the storage cassettes 31A to 31C, a storage condition that only large-denomination notes be stored and, for at least one of the storage cassettes 31D to 31F, a storage condition that only large-denomination notes be stored. That is, denominations to be stored in the storage cassettes 31A to 31C remain the same regardless of the non-self-service mode or the self-service mode, and denominations to be stored in at least one of the storage cassettes 31D to 31F change between the non-self-service mode and the self-service mode.

In the present embodiment, in the self-service mode, a storage condition that large-denomination notes be stored is set for the storage cassettes 31D to 31F. As a result, in the self-service mode, a storage condition that only large-denomination notes be stored is set for all the storage cassettes 31A to 31F, and the banknote processing apparatus 1 is essentially prohibited from storing small-denomination notes. In general, the number of small-denomination notes (e.g., 1,000 yen notes) in circulation is larger than the number of large-denomination notes (e.g., 10,000 yen notes) in circulation in an area in which the banknote processing apparatus 1 is installed, and a storage cassette 31 for the small-denomination notes tends to become full soon. Until the operator takes out the small-denomination notes from the storage cassette 31, the banknote processing apparatus 1 stops performing processes. In a period of time in which the self-service mode is used, however, the operator is absent. In the self-service mode, therefore, a storage condition that only large-denomination notes be stored is set for the storage cassettes 31A to 31F so that the storage cassettes 31A to 31F do not become full.

(1-2) Alternatively, in the non-self-service mode, the control section 10 sets, for the storage cassettes 31A to 31C, a storage condition that only small-denomination notes be stored and, for the storage cassettes 31D to 31F, a storage condition that only large-denomination notes be stored. In the self-service mode, on the other hand, the control section 10 sets, for the storage cassettes 31A to 31C, a storage condition that only small-denomination notes be stored as in the non-self-service mode and, for at least one of the storage cassettes 31D to 31F, a storage condition that only small-denomination notes be stored. In the self-service mode, therefore, the number of storage cassettes 31 for storing small-denomination notes becomes larger than in the non-self-service mode. As a result, a condition in which the small-denomination notes, which are circulating the most in the area in which the banknote processing apparatus 1 is installed and taken in the most in the banknote processing apparatus 1, cannot be taken in the banknote processing apparatus 1 can be suppressed.

(1-3) When the banknote processing apparatus 1 is installed near a border, the banknote processing apparatus 1 is used to deposit and withdraw banknotes issued in a country A (or an area) in which the banknote processing apparatus 1 is installed and banknotes issued in a neighboring country B (or a neighboring area) beyond the border. In the self-service mode, therefore, the control section 10 sets, for the storage cassettes 31D and 31E, a storage condition that the banknotes issued in the country A be stored and, for the storage cassette 31F, a storage condition that the banknotes issued in the neighboring country B be stored. As a result, even if a banknote issued in the neighboring country B (foreign currency) is put in the banknote processing apparatus 1 that is operating in the self-service mode, the banknote can be processed, which improves convenience. In addition, since the banknotes issued in the neighboring country B are not withdrawn, the banknotes issued in the neighboring country B are stored in the storage cassette 31F of the stacking type, which is not suitable for withdrawal. In addition, by storing the banknotes issued in the country A in the storage cassettes 31D and 31E of the winding type, another customer who desires to withdraw banknotes issued in the country A can use banknotes stored in the storage cassettes 31D and 31E of the winding type, even if the storage cassettes 31A to 31C are not available. Currency in the country A, therefore, can be easily recycled.

(1-4) When the operation mode has been switched between the self-service mode and the non-self-service mode, the control section 10 first controls a storage cassette 31 for which a storage condition has been changed and the transport section 41 such that all banknotes stored in the storage cassette 31 are fed. The banknotes may be fed, for example, to the storage cassette 31F. As a result, banknotes of a different denomination are stored in the storage cassette 31 after the storage condition is changed, and mixing of banknotes of different denominations in a single storage cassette 31 can be prevented.

(2) Adjustment of Capacity

The control section 10 counts the number of large-denomination notes and small-denomination notes taken in the banknote processing apparatus 1 (hereinafter referred to as the "number of notes taken in") on the basis of a result of recognition performed by the recognition section 25. If the number of large-denomination notes taken in reaches an upper limit, the control section 10 rejects large-denomination notes taken in the banknote processing apparatus 1 thereafter from the inlet section 21 or the outlet section 23. Similarly, if the number of small-denomination notes taken in reaches an upper limit, the control section 10 rejects small-denomination notes taken in the banknote processing apparatus 1 thereafter. In the non-self-service mode, the control section 10 sets the same upper limit for large-denomination notes and small-denomination notes, and in the self-service mode, the control section 10 sets the upper limit for large-denomination notes higher than that for small-denomination notes. As a result, the number of small-denomination notes taken in is relatively strictly restricted, and storage cassettes 31 for small-denomination notes do not easily become full.

(3) Restriction on Reception

In the non-self-service mode, the control section 10 does not restrict taking in (reception) of banknotes regardless of whether the banknotes are large-denomination notes or small-denomination notes. In the self-service mode, on the other hand, if the recognition section 25 determines that banknotes that have been taken in are small-denomination notes, the control section 10 rejects the small-denomination notes. That is, in the self-service mode, the banknote processing apparatus 1 prohibits taking in (reception) of small-denomination notes and permits only taking in of large-denomination notes. As a result, in the self-service mode, storage cassettes 31 for small-denomination notes are prevented in advance from becoming full.

(4) Adjustment of Fitness Threshold

The control section 10 determines whether a banknote is a fit note or an unfit note by comparing a result of recognition performed by the recognition section 25 on the banknote with a fitness determination value. If determining that a banknote is an unfit note, the control section 10 causes the transport section 41 to transport the unfit note to the collection cassette 32. The control section 10 then makes the fitness determination value stricter in the self-service mode than in the non-self-service mode. That is, in the self-service mode, compared to the non-self-service mode, banknotes need to be less unfit to be recognized as fit notes, and, for example, even banknotes recognized as fit notes in the non-self-service mode might be determined as unfit notes in the self-service mode and transported to the collection cassette 32. As a result, a risk of a jam or the like in the storage cassettes 31 due to unfitness of banknotes is more strongly suppressed in the self-service mode than in the non-self-service mode.

(5) Restriction on Reception of Unfit Notes

If it is determined on the basis of a result of recognition performed by the recognition section 25 on a banknote that the banknote is an unfit note, the control section 10 determines a type of unfit note. More specifically, the unfit note is determined as any of a soiled note, a thickened note, and a mutilated note. A soiled note is a dirty note. A thickened note is a torn note that has been increased in thickness due to adhesive tape attached to a torn portion. A mutilated note is a note having a missing part. In the non-self-service mode, the control section 10 receives a banknote that has been taken in even if the banknote is a soiled note, a thickened note, or a mutilated note, and then causes the transport section 41 to transport the banknote to the collection cassette 32. In the self-service mode, on the other hand, if a deposited banknote is a thickened note or a mutilated note, the control section 10 causes the transport section 41 to reject the banknote that has been taken in. As a result, in the self-service mode, a risk of a jam or the like in the transport section 41 due to unfitness of banknotes is more strongly suppressed than in the non-self-service mode.

(6) Adjustment of Jams

The control section 10 uses a jam monitoring timer, which is not illustrated, to monitor a period of time taken by a banknote that has been taken in to pass through a certain range of the transport section 41 and, if the period of time exceeds a certain value, determines that a jam has occurred. In the self-service mode, the control section 10 makes the jam monitoring timer more generous than in the non-self-service mode. That is, in the non-self-service mode, a timer value is set relatively small and an abnormality is detected at an early time point in order to prevent miscalculation of the amount of money taken in, and in the self-service mode, on the other hand, the timer value is set larger than in the non-self-service mode or the jam monitoring timer does not perform the monitoring. This is because, in the self-service mode, even if the timer value of the jam monitoring timer is exceeded and an abnormality is detected, the operator is absent and recovery work is not possible. That is, it is assumed that the banknote processing apparatus 1 will solve a jam through a process performed thereby when the timer value is large and a period of time taken until the banknote processing apparatus 1 stops due to an abnormality is long. In addition, the reason why the jam monitoring timer does not perform the monitoring is that, even if a jam occurs, banknotes are held inside the banknote processing apparatus 1 and an organization, such as the bank, that owns the banknote processing apparatus 1 will not suffer a loss in this situation.

(7) Shutter Operation

In the non-self-service mode, even if the customer has left banknotes in the outlet 231, it is unlikely that a third party other than the customer will take away the banknotes, since the operator is keeping an eye on the banknote processing apparatus 1. In the non-self-service mode, therefore, the control section 10 keeps the shutter 23*a* open by controlling the shutter 23*a*. In the self-service mode, on the other hand, since the operator is absent, the control section 10 keeps the shutter 23*a* open during a withdrawal operation, in which banknotes are transported to the outlet 231, and keeps the shutter 23*a* closed before and after the withdrawal operation. That is, in the self-service mode, the shutter 23*a* remains open only during the withdrawal operation, and at other times, the shutter 23*a* is closed. In the self-service mode, which is used when the operator is absent, therefore, the shutter 23*a* closes the outlet 231, and a third party is prevented from taking away banknotes in the outlet 231, even if the customer has left the banknotes in the outlet 231. Alternatively, the banknote processing apparatus 1 may be configured to resume or continue operation in the self-service mode by, if the customer has left banknotes in the outlet 231, transporting the banknotes to the display apparatus 31F, for example, after closing the shutter 23*a*.

(8) Destination of Reset Notes

Banknotes remaining in the transport section 41 or the temporary storage section 51 of the banknote processing apparatus 1 due to some abnormality in the banknote processing apparatus 1 are called "reset notes". In the non-self-service mode, the control section 10 transports reset notes to the outlet 231, and in the self-service mode, the control section 10 transports reset notes to the collection cassette 32. The reason why reset notes are transported to the collection cassette 32 in the self-service mode is that, if reset notes are transported to the outlet 231 as in the non-self-service mode, the reset note might be taken away since the operator who is supposed to keep an eye on the banknote processing apparatus 1 is absent.

(9) Deposit Process

In the non-self-service mode, the control section 10 causes the transport section 41 to directly transport banknotes that have been taken in to the storage cassettes 31 without using the temporary storage section 51 (direct deposit), and in the self-service mode, the control section 10 causes the transport section 41 to transport banknotes that have been taken in to the storage cassettes 31 through the temporary storage section 51 (indirect deposit). In the indirect deposit, in which the temporary storage section 51 is used, unlike in the direct deposit, the customer can be asked to confirm a deposit process before the deposit process is confirmed but after banknotes of the customer are transported to the temporary storage section 51. As a result, when the customer desires to cancel the taking in of banknotes, for example, the banknotes taken in by the customer can be transported to the outlet 231 from the temporary storage section 51 and returned to the customer. In the self-service mode, which is used when the operator is absent, therefore, the indirect deposit, in which banknotes that have been taken in are transported to the temporary storage section 51, is performed.

(10) Restriction on Processes

In the non-self-service mode, the control section 10 does not restrict processes performed by the banknote processing apparatus 1, and in the self-service mode, the control section 10 restricts processes performed by the banknote processing apparatus 1 only to the deposit process and prohibits the withdrawal process and collection of banknotes from the banknote processing apparatus 1. In the self-service mode, the control section 10 restricts processes performed by the banknote processing apparatus 1 only to the deposit process and prevents a person who has retired from the bank, for example, from unlawfully taking away banknotes from the banknote processing apparatus 1 using an illegitimate ID code. That is, in the self-service mode, which is used when the operator who is supposed to keep an eye on the banknote processing apparatus 1 is absent, a stricter level of security than in the non-self-service mode is employed.

(11) Restriction on Number of Transactions

In the non-self-service mode, the control section 10 does not restrict the number of transactions per day conducted by the same customer, and in the self-service mode, the control section 10 restricts the number of transactions per day conducted by the same customer. That is, a customer who withdraws money a certain number of times or more in a day is assumed to be possibly carrying out an unlawful act, and in the self-service mode, the number of transactions per day conducted by the same customer is restricted. Even if the customer is actually carrying out an unlawful act, an effect of the unlawful act is minimized in this case.

(12) Collection of Counterfeit Notes (12-1) The control section 10 determines, on the basis of a result of recognition performed by the recognition section 25 on a banknote, whether the banknote is a genuine note, a counterfeit note, or a suspect note. A suspect note is a banknote that cannot be recognized as a genuine note or a counterfeit note. In the non-self-service mode, if it is determined that the banknote is a counterfeit note, the control section 10 causes the transport section 41 to transport the counterfeit note to the collection cassette 32, for example, and if it is determined that the banknote is a suspect note, the control section 10 causes the transport section 41 to transport the suspect note to the outlet section 23. The operator then checks the authenticity of the suspect note transported to the outlet section 23. In the self-service mode, on the other hand, the control section 10 transports both a banknote determined as a counterfeit note and a banknote determined as a suspect note to, for example, the collection cassette 32. That is, in the self-service mode, not only counterfeit notes but also suspect notes are collected by the banknote processing apparatus 1 since the operator who checks the authenticity of the suspect notes is absent.

(12-2) Alternatively, if it is determined, on the basis of a result of recognition performed by the recognition section 25 on a banknote, that the banknote is a counterfeit note, the control section 10 may perform the following control operation. That is, the control section 10 stores at least either account information (user information) regarding the customer obtained by the card reader 60 or recognition information (user information) regarding the customer obtained by the biometric authentication apparatus 61 in the memory section 10*a*. The control section 10 then causes the transport section 41 to, in the non-self-service mode, transport the counterfeit note to the inside of the banknote processing apparatus 1 (e.g., the collection cassette 32) and hold the counterfeit note or, in the self-service mode, transport the counterfeit note to the outlet 231 (discharge section) and reject the counterfeit note.

(13) Login

When the banknote processing apparatus 1 comprises both the card reader 60 and the biometric authentication apparatus 61, the control section 10, in the non-self-service mode, enables the customer to log in the banknote processing apparatus 1 if the card reader 60 has successfully read legitimate customer information from a cash card. In the self-service mode, on the other hand, the control section 10 enables the customer to log in the banknote processing apparatus 1 if the card reader 60 has successfully read legitimate customer information from a cash card and legitimate customer information from the biometric authentication apparatus 61. That is, when the operator is absent, illegitimate login is prevented through double authentication, that is, the authentication based on a cash card and the biometric authentication.

(14) Unlocking Condition of Safe Door

In the non-self-service mode, when unlocking the electronic lock 133*a* of the door 133 of the safe section 13, the control section 10 requests inputting of an ID number set to the electronic lock 133*a* and, if the input ID number is correct, unlocks the electronic lock 133*a*. In the self-service mode, on the other hand, the control section 10 requests inputting of not only the ID number but also an ID of a person in charge and, if the ID number is correct and the ID is that of a person who is authorized to collect banknotes, unlocks the electronic lock 133*a*. The authentication based on an ID of a worker is performed, for example, through remote authentication performed by a higher server connected to the control section 10.

(15) Maintenance Worker Mode

In the non-self-service mode, when unlocking the electronic lock 133*a* of the door 133 of the safe section 13, the control section 10 requests inputting of an ID number set to the electronic lock 133*a* and, if the input ID number is correct, unlocks the electronic lock 133*a*. In the self-service mode, on the other hand, the control section 10 requests inputting of not only the ID number but also an ID of a person in charge and, if the ID number is correct and the ID is that of a person who is authorized to perform maintenance work, unlocks the electronic lock 133*a*.

3. Advantageous Effects

A storage condition is changed between when the operation mode is the self-service mode and when the operation mode is the non-self-service mode for at least one of the storage cassettes 31. In this case, the storage condition can be appropriately set for the at least one of the storage cassettes 31 in accordance with the operation mode. According to the embodiment of the present invention, therefore, the banknote processing apparatus 1 performs appropriate operations in accordance with various use conditions, which improves convenience of the banknote processing apparatus 1.

In the self-service mode, at least one of the storage cassettes 31 is caused to store a denomination that is circulating the most in the area in which the banknote processing apparatus 1 is installed. That is, the number of storage cassettes 31 assigned to the denomination that is circulating the most is increased. As a result, in the self-service mode, which is used when the operator is absent, the storage cassettes 31 assigned to the denomination that is circulating the most do not easily become full, and the banknote processing apparatus 1 can process banknotes more stably in the self-service mode.

When the operation mode has been changed between the self-service mode and the non-self-service mode, the control section 10 causes a storage cassette 31 for which a storage condition has been changed as a result of the change in the operation mode to feed all banknotes stored in the storage cassette 31. As a result, banknotes of a different denomination are stored in the storage cassette 31 after the storage condition is changed, and mixing of banknotes of different denominations in a single storage cassette 31 can be prevented.

Since the storage cassettes 31D, 31E, and 31F are removably attached to the banknote processing apparatus 1, the storage cassettes 31D, 31E, and 31F can be used as collection cassettes. As a result, an operation range of the banknote processing apparatus 1 is increased, which further improves the convenience of the banknote processing apparatus 1.

In the self-service mode, the fitness determination value is changed such that a criterion for determining that banknotes are fit notes becomes stricter than in the non-self-service mode. In the self-service mode, therefore, banknotes transported to the storage cassettes 31 are less unfit than in the non-self-service mode, and a risk of a jam or the like is suppressed. In the self-service mode, which is used when the operator is absent, the banknote processing apparatus 1 can stably process banknotes.

In the self-service mode, the banknote processing apparatus 1 collects banknotes determined as counterfeit notes, that is, counterfeit notes can be appropriately handled even when the operator is absent.

The control section 10 switches between the self-service mode and the non-self-service mode on the basis of time information. The switching between the self-service mode and the non-self-service mode, therefore, can be securely performed. When the operator switches between the self-service mode and the non-self-service mode using the operator terminal 200 or the operation display section 100, the operator can switch between the self-service mode and the non-self-service mode at appropriate timings in accordance with situations.

4. Modifications

[4-1. Modification 1]

As described above, the storage cassettes 31D, 31E, and 31F can be taken out of the safe section 13 and may be used as collection cassettes. As described above, the storage cassettes 31D and 31E are of the winding type, and the storage cassette 31F is of the stacking type. That is, two different types, namely the winding type and the stacking type, are used for the collection cassettes in the banknote processing apparatus 1.

Even when the storage cassettes 31D and 31E of the winding type store various types of banknote as collection cassettes, the storage cassettes 31D and 31E can easily manage banknotes to be fed, since the stored banknotes are fed in reverse order to order of storage. The storage cassettes 31D and 31E, therefore, are suitable to collect banknotes to be reused for withdrawal or the like. In the case of the storage cassette 31F of the stacking type, on the other hand, banknotes are not necessarily stacked in order of storage. When the storage cassette 31F stores various types of banknote as a collection cassette, therefore, it is not easy for the storage cassette 31F to manage banknotes to be fed. The storage cassette 31F, however, is suitable to collect a large number of banknotes.

The convenience of the banknote processing apparatus 1, therefore, can be improved by setting banknotes to be assigned to the storage cassettes 31D and 31E and banknotes to be assigned to the storage cassette 31F such that characteristics of the storage cassettes 31D and 31E of the winding type and characteristics of the storage cassette 31F of the stacking type are utilized.

Table 2 below indicates patterns (assignment patterns) of banknotes to be assigned to the storage cassettes 31D, 31E, and 31F when the storage cassettes 31D, 31E, and 31F are used as collection cassettes. When the storage cassettes 31D, 31E, and 31F are used as collection cassettes, banknotes that cannot be stored in the storage cassettes 31A, 31B, and 31C are stored in the storage cassettes 31D, 31E, and 31F.

TABLE 2

| | | Storage cassettes 31D and 31E (winding type) | Storage cassette 31F (stacking type) |
|---|---|---|---|
| Non-self-service mode | Assignment pattern 1 | Same as before | Same as before |
| | Assignment pattern 2 | New series notes | Old series notes<br>*Collected old series notes cannot be returned |
| | Assignment pattern 3 | Same as before | Forcibly collected notes |
| | Assignment pattern 4 | Banknotes without clear window<br>*Ordinary cassettes are used | Banknotes with clear window<br>*Sensor-added cassette is necessary |
| Self-service mode | Assignment pattern 5 | Overflow notes | Unspecified denominations<br>*Basically banknotes to be collected |
| | Assignment pattern 6 | Unspecified denominations, overflow notes<br>*Banknotes belonging to bank | Retracted notes (lost notes)<br>*Banknotes belonging to customers (pending notes) |
| | Assignment pattern 7 | Unfit notes | Counterfeit notes, suspect notes<br>*Cannot be returned in self-service mode |
| | Assignment pattern 8 | Forcibly collected notes (serial numbers readable)<br>*Reliable notes (traceable) | Forcibly collected notes (serial numbers unreadable)<br>*Unreliable notes (untraceable) |
| | Assignment pattern 9 | Soiled notes, abnormalities in denomination determinations | Shape-rejected notes, torn notes, skewed notes<br>*For reducing jam errors during transportation |
| | Assignment pattern 10 | Abnormal notes supplied from inlet | Abnormal notes manually stored in cassettes<br>*Stored separately |

The assignment patterns on Table 2 above will be described hereinafter. Assignment patterns 1 to 4 are an example of assignment patterns used in the non-self-service mode, and assignment patterns 5 to 10 are an example of assignment patterns used in the self-service mode.

(1) Assignment Pattern 1

The same types of banknote as for a conventional collection cassette are assigned to the storage cassettes 31D, 31E, and 31F. That is, unfit notes, counterfeit notes, and banknotes overflown from the storage cassettes 31A, 31B, and 31C are stored. Although the number of collection cassettes in conventional banknote processing apparatuses is generally one, the capacity of the collection cassette can be significantly increased essentially since the storage cassettes 31D, 31E, and 31F are also used as collection cassettes.

(2) Assignment Pattern 2

New series notes are stored in the storage cassettes 31D and 31E. Since the storage cassettes 31D and 31E, which are of the winding type, can easily manage types of banknote to be fed, stored new series notes are fed from the storage cassette 31D or 31E. Old series notes, on the other hand, are stored in the storage cassette 31F. Because old series notes are collected by banks and not basically deposited, the old series notes are stored in the storage cassette 31F of the stacking type.

(3) Assignment Pattern 3

The same types of banknote as for a conventional collection cassette are assigned to the storage cassettes 31D and 31E. Forcibly collected notes are assigned to the storage cassette 31F. The forcibly collected notes refer to banknotes that have not been recognized by the recognition section 25 as fit notes due to peeling of a pattern or the like but have been determined by the operator as fit notes and collected in the banknote processing apparatus 1.

(4) Assignment Pattern 4

Polymer notes comprising a transparent portion such as a clear window are assigned to the storage cassette 31F. Banknotes without a clear window are assigned to the storage cassettes 31D and 31E. The storage cassettes 31 usually comprise optical sensors for detecting holes in banknotes and the like. Such ordinary storage cassettes (ordinary cassettes) comprising optical sensors are used as the storage cassettes 31D and 31E to which banknotes without a clear window are assigned. Only with the optical sensors, however, clear windows might be erroneously detected as holes in banknotes. For this reason, a storage cassette (a sensor-added cassette) to which a reflective sensor or an ultrasonic sensor is added is used as the storage cassette 31F to which polymer notes comprising a clear window are assigned.

(5) Assignment Pattern 5

Banknotes overflown from the storage cassettes 31A, 31B, and 31C are assigned to the storage cassettes 31D and 31E, and stored banknotes are reused for withdrawal. Banknotes of unspecified denominations, that is, banknotes of denominations other than ones set for the storage cassettes 31A, 31B, and 31C (banknotes to be usually collected (collection notes)) are assigned to the storage cassette 31F.

(6) Assignment Pattern 6

Banknotes overflown from the storage cassettes 31A, 31B, and 31C and banknotes of unspecified denominations, that is, banknotes of denominations other than ones set for the storage cassettes 31A, 31B, and 31C, are assigned to the storage cassettes 31D and 31E. In other words, banknotes belonging to the bank, that is, banknotes counted as ones stored in a safe, are stored in the storage cassettes 31D and 31E. Banknotes left by the customer in the outlet 231 (retracted notes), on the other hand, are assigned to the storage cassette 31F. In other words, pending notes, that is, banknotes that have not been counted as banknotes to be stored in the safe section 13, are stored in the storage cassette 31F.

(7) Assignment Pattern 7

Unfit notes are assigned to the storage cassettes 31D and 31E. Counterfeit notes and suspect notes are assigned to the storage cassette 31F. Since counterfeit notes and suspect notes are not returned to the customer in the self-service mode, such banknotes are assigned to the storage cassette 31F, which is not suitable for feeding.

(8) Assignment Pattern 8

Among forcibly collected notes, banknotes whose serial numbers have been recognized by the recognition section 25, that is, reliable banknotes whose depositors can be specified and that are traceable, are assigned to the storage cassettes 31D and 31E. Among forcibly collected notes, banknotes whose serial numbers have not been recognized by the recognition section 25, that is, unreliable banknotes whose depositors cannot be specified and that are untraceable, are assigned to the storage cassette 31F.

(9) Assignment Pattern 9

Soiled notes and banknotes whose denominations have not been determined by the recognition section 25 (abnormalities in denomination determinations) are assigned to the storage cassettes 31D and 31E. Banknotes rejected due to shapes thereof, such as tears or mutilation, torn notes, and skewed notes are assigned to the storage cassette 31F. The storage cassette 31F collects shape-rejected notes, torn notes, and skewed notes in the self-service mode in order to prohibit reuse of such notes and prevent jam errors that might otherwise occur during transportation.

(10) Assignment Pattern 10

Abnormal notes among banknotes supplied from the inlet 211 for withdrawal, that is, unfit notes and banknotes that are not suitable for recycling, are assigned to the storage cassettes 31D and 31E. If a banknote supplied from the inlet 211 for withdrawal is a counterfeit note, the counterfeit note is rejected. Among banknotes stored in the storage cassettes 31A to 31D in advance, abnormal notes, that is, banknotes not to be withdrawn, such as counterfeit notes, are assigned to the storage cassette 31F. The banknotes stored in the storage cassettes 31A to 31D in advance refer to banknotes supplied to storage cassettes 31 with insufficient banknotes. More specifically, if the number of banknotes stored in one of the storage cassettes 31A to 31D is insufficient, the storage cassette 31 is taken out of the banknote processing apparatus 1 and banknotes are manually supplied to the storage cassette 31. The banknotes stored in the storage cassettes 31A to 31D in advance refer to these banknotes. If the banknotes stored in the storage cassettes 31A to 31D in advance include an abnormal note, the abnormal note is detected during the withdrawal process when the banknote passes by the recognition section 25, and then stored in the storage cassette 31F so that the banknote is not fed out from the banknote processing apparatus 1.

When the storage cassettes 31D and 31E of the winding type and the storage cassette 31F of the stacking type are used as collection cassettes, the same assignment pattern may be used regardless of the non-self-service mode or the self-service mode. In other words, when the storage cassettes 31D and 31E of the winding type and the storage cassette 31F of the stacking type are used as collection cassettes, the operation mode need not be switched between the self-service mode and the non-self-service mode.

[4-2. Modification 2]

Figure 2:
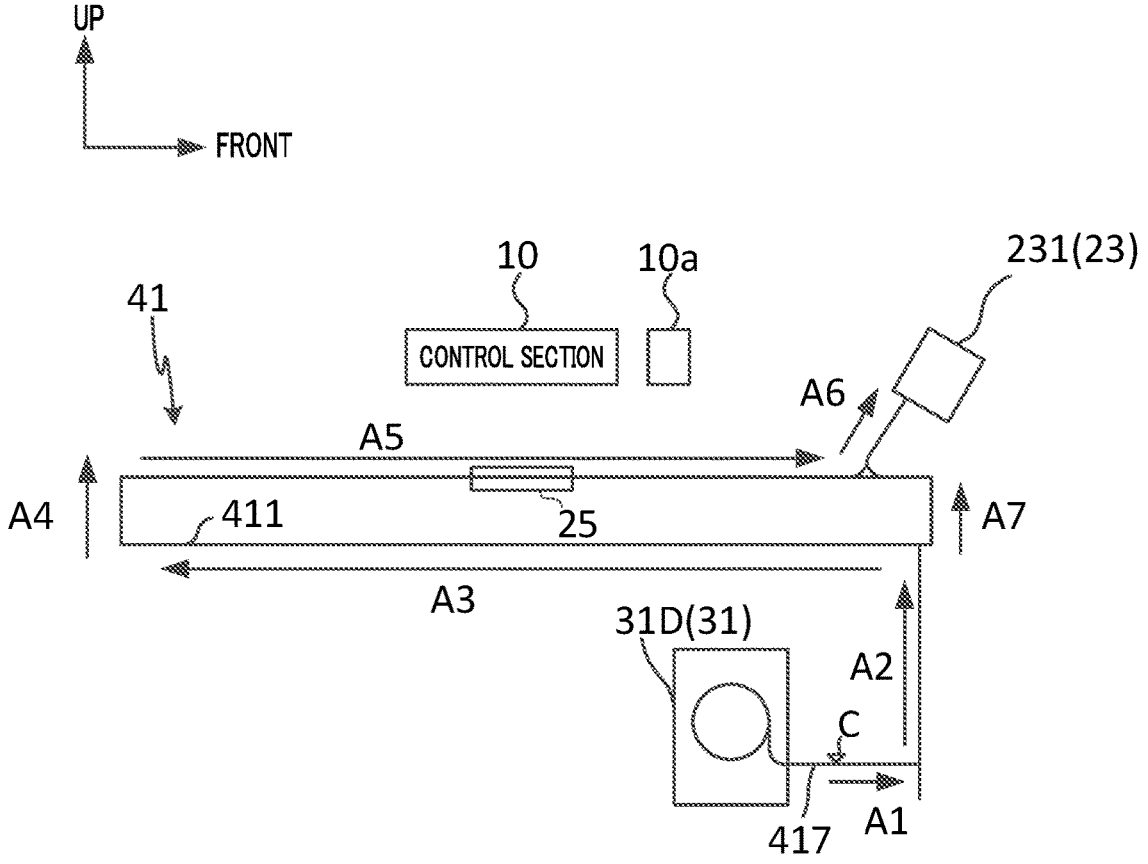
FIG. 2 is a schematic diagram illustrating a method for detecting an abnormality in a banknote and a side view illustrating a main part of the banknote processing apparatus.
Figure 3:
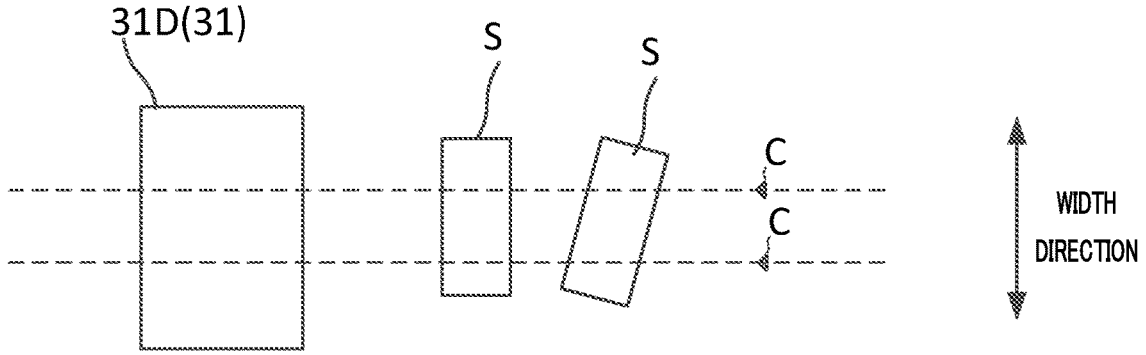
FIG. 3 is a schematic diagram illustrating the method for detecting an abnormality in a banknote and a plan view illustrating the main part of the banknote processing apparatus.

A method for detecting an abnormality in a banknote to be withdrawn using the optical sensors C instead of the recognition section 25 when the recognition section 25 has stopped working will be described with reference to FIGS. 2 and 3. FIG. 2 is a schematic diagram illustrating the method for detecting an abnormality in a banknote and a side view illustrating a main part of the banknote processing apparatus 1. FIG. 3 is a schematic diagram illustrating the method for detecting an abnormality in a banknote and a plan view illustrating the main part of the banknote processing apparatus 1.

When the banknote processing apparatus 1 feeds and withdraws a banknote S (sheet) from the storage cassette 31D, for example, the banknote S is usually transported in order of arrows A1, A2, A3, A4, A5, and A6 in FIG. 2, and the recognition section 25 recognizes the banknote S.

If a signal indicating a result of the recognition is not transmitted from the recognition section 25 or a signal indicating a result of the recognition indicates an abnormality, the control section 10 determines that the recognition section 25 has stopped working. If determining that the recognition section 25 has stopped working, the control section 10 causes the transport section 41 to transport the banknote S to the outlet section 23 in order of the arrows A1, A2, A7, and A6. At this time, the control section 10 uses the optical sensors C to detect an abnormality in the banknote S fed from the storage cassette 31D, such as deformation.

The method for detecting an abnormality in the banknote S using the optical sensors C will be described. A plurality of (two here) optical sensors C are aligned in a width direction of the banknote processing apparatus 1 as illustrated in FIG. 3. The control section 10 detects a skew angle of the banknote S on the basis of time points at which light incident on the optical sensors C aligned in the width direction of the banknote processing apparatus 1 is blocked by the banknote S. The control section 10 detects the skew angle of the banknote S each time the banknote S has been stored in the storage cassette 31D, and stores the skew angle in the memory section 10*a*.

When the recognition section 25 has stopped working, the control section 10 detects the skew angle of the banknote S fed from the storage cassette 31D using the optical sensors C and reads, from the memory section 10*a*, the skew angle of the banknote S at a time of the storage in the storage cassette 31D. The control section 10 then compares the skew angle of the banknote S at the time of the storage in the storage cassette 31D and a skew angle at a time of the feeding from the storage cassette 31D with each other. If a difference between these skew angles is equal to or larger than a threshold, the control section 10 determines that there is an abnormality in the banknote S, such as deformation, and if the difference is smaller than the threshold, the control section 10 determines that the banknote S is normal.

INDUSTRIAL APPLICABILITY

The present invention can be applied to sheet processing apparatuses, and industrial applicability thereof is high.

REFERENCE SIGNS LIST

1 banknote processing apparatus (sheet processing apparatus)
3 storage section
10 control section
10*a* memory section
11 processing section
13 safe section
21 inlet section
21*a* shutter
23 outlet section
23*a* shutter
25 recognition section
31, 31A to 31F storage cassette
32 collection cassette
41 transport section
51 temporary storage section
60 card reader
61 biometric authentication apparatus
100 operation display section (first operation terminal, mode selection section)
111 case
131 case
133 door
133*a* electronic lock
200 operator terminal (second operation terminal, mode selection section)
211 inlet
231 outlet (discharge section)
311 stacking board
312 reel
411 transport path
413 input path
415 output path
416, 417 branch path
C optical sensor
S banknote (sheet)

The invention claimed is:

1. A sheet processing apparatus that operates in a self-service mode in which a user does not receive operation support provided by an operation assistant, and a non-self-service mode in which the user receives the operation support, the sheet processing apparatus comprising:

an inlet that takes in sheets in a deposit process;

a conveyor that transports the sheets taken in from the inlet;

a plurality of storages that stores the sheets transported by the conveyor; and a controller that causes the conveyor to transport the sheets to the plurality of storages, based on storage conditions for storing the sheets in the plurality of storages, wherein the controller changes a condition of the sheet processing apparatus between when an operation mode is the self-service mode and when an operation mode is the non-self-service mode, and thereby the controller changes the storage conditions and operates the conveyor and at least one of the plurality of storages, wherein the controller receives an operation instruction from a first operation terminal that receives an operation performed by the user but does not receive an operation instruction from a second operation terminal that receives an operation performed by the operation assistant in the self-service mode, and the controller receives operation instructions from both the first operation terminal and the second operation terminal in the non-self-service mode, and wherein the second operation terminal is located away from a case of the sheet processing apparatus.

2. The sheet processing apparatus according to claim 1, wherein the plurality of storages includes a first storage, a second storage, and a third storage, wherein the controller sets, for the first storage, a storage condition that a denomination of the sheets be a certain denomination regardless of the self-service mode or the non-self-service mode, and wherein the controller sets, for at least either the second storage or the third storage, different storage conditions between the self-service mode and the non-self-service mode.

3. The sheet processing apparatus according to claim 2, wherein, in the self-service mode, the controller sets, for at least either the second storage or the third storage, a same storage condition as the storage condition for the first storage.

4. The sheet processing apparatus according to claim 2, wherein, in the self-service mode, the controller sets, for at least either the second storage or the third storage, a storage condition that the denomination of the sheets be a denomination corresponding to sheets that are circulating the most in an area in which the sheet processing apparatus is installed.

5. The sheet processing apparatus according to claim 2, wherein, in the self-service mode, the controller sets, for the second storage, a storage condition that the denomination of the sheets be a denomination corresponding to sheets issued in an area in which the sheet processing apparatus is installed, and for the third storage, a storage condition that the denomination of the sheets be a denomination issued in an area other than the area in which the sheet processing apparatus is installed.

6. The sheet processing apparatus according to claim 2, wherein, when switching is performed between the self-service mode and the non-self-service mode, the controller causes at least either the second storage or the third storage to feed all sheets stored.

7. The sheet processing apparatus according to claim 2, wherein at least either the second storage or the third storage is removably attached to the sheet processing apparatus.

8. The sheet processing apparatus according to claim 2, wherein the second storage is either a storage of a winding type in which the sheets are wound up and stored, or a storage of a stacking type in which the sheets are stacked on one another and stored, and wherein the third storage is another of the storage of the winding type and the storage of the stacking type.

9. The sheet processing apparatus according to claim 1, wherein the controller sets the operation mode to the self-service mode or the non-self-service mode based on time information obtained.

10. The sheet processing apparatus according to claim 1, wherein, in the self-service mode, the controller restricts the deposit process by restricting a process for storing sheets in the plurality of storages.

11. The sheet processing apparatus according to claim 10, further comprising:

a recognition sensor that recognizes a denomination of the sheets taken in from the inlet, wherein the controller monitors, based on recognition information obtained by the recognition sensor, the denomination of the sheets deposited in the deposit process, a number of sheets deposited in the deposit process, and a number of times that the deposit process is performed, and wherein the controller restricts, as a restriction on the deposit process, at least the denomination of the sheets, the number of sheets, or the number of times that the deposit process is performed.

12. The sheet processing apparatus according to claim 1, further comprising:

a recognition sensor that obtains fitness information indicating a degree of fitness of the sheets taken in from the inlet, wherein the controller determines, by comparing the fitness information with a set threshold, whether the sheets are fit notes, and wherein, in the self-service mode, the controller changes the threshold such that a criterion for determining that the sheets are fit notes in the self-service mode becomes stricter than a criterion for determining that the sheets are fit notes in the non-self-service mode.

13. The sheet processing apparatus according to claim 1, further comprising:

at least either a card reader or a biometric sensor that obtains user information regarding the user who performs the deposit process;

a recognition sensor that obtains authenticity information regarding authenticity of the sheets;

a discharge port that stores sheets that are not stored in any of the plurality of storages; and a memory, wherein the controller stores the user information in the memory when determining that the sheets are counterfeit notes based on the authenticity information, wherein, in the self-service mode, the controller causes the conveyor to hold the sheets determined as counterfeit notes in the sheet processing apparatus, and wherein, in the non-self-service mode, the controller causes the conveyor to transport the sheets determined as counterfeit notes to the discharge port.

14. The sheet processing apparatus according to claim 2, wherein at least either the second storage or the third storage feeds the stored sheets.

15. The sheet processing apparatus according to claim 1, further comprising:

a mode selector that receives an operation for selecting the operation mode, wherein the controller sets the operation mode to the self-service mode or the non-self-service mode based on operation mode information received by the mode selector.

16. The sheet processing apparatus according to claim 1, further comprising:

an outlet that feeds out the sheets, wherein the outlet is provided with an openable shutter, and wherein, in the self-service mode, the controller causes the shutter to keep an open state during a withdrawal operation in which the conveyer is controlled to transport the sheets to the outlet, and causes the shutter to keep a closed state when the withdrawal operation is not performed.

* * * * *